US005615525A

United States Patent [19]

Kenworthy

[11] Patent Number: 5,615,525

[45] **Date of Patent: *Apr. 1, 1997**

[54] THERMOPLASTIC FOAM INSULATION AND DRAINAGE BOARD IN BELOW-GRADE APPLICATIONS

[75] Inventor: Linda L. Kenworthy, Gahanna, Ohio

[73] Assignee: The Dow Chemical Company, Midland, Mich.

[ * ] Notice: The term of this patent shall not extend beyond the expiration date of Pat. No. 5,511,346.

[21] Appl. No.: 594,066

[22] Filed: Jan. 30, 1996

Related U.S. Application Data

[63] Continuation of Ser. No. 295,368, Aug. 24, 1994, Pat. No. 5,511,346.

[51] Int. Cl.[6] ..... E02D 31/02

[52] U.S. Cl. ..... 52/169.5; 52/169.11; 52/169.14; 52/302.3; 52/302.4; 405/45

[58] Field of Search ..... 52/169.5, 169.11, 52/169.14, 302.1, 302.3, 302.4, 741.3; 405/43, 45

[56] References Cited

U.S. PATENT DOCUMENTS

| | | | |
|---|---|---|---|
| 4,309,855 | 1/1982 | Pate et al. | 52/169.5 |
| 4,318,258 | 3/1982 | Heck | 52/309.12 |
| 4,704,048 | 11/1987 | Alhgrimm | 405/45 |
| 5,056,281 | 10/1991 | McCarthy | 52/169.5 |
| 5,511,346 | 4/1996 | Kenworthy | 52/169.5 |

*Primary Examiner*—Robert Canfield
*Attorney, Agent, or Firm*—J. Robert Dean, Jr.

[57] ABSTRACT

Disclosed is a rigid, thermoplastic foam board useful in below-grade residential and commercial insulating and drainage applications. The board defines a plurality of oriented channels extending therein along the board. The channel extends into the board through a relatively narrow first opening at the face into a relatively wide first zone. The channel then further extends into the board from the first zone through a relatively narrow second opening into a second zone. The board provides superior water drainage, and protects a below-grade building wall from excessive moisture. Further disclosed is a method for using the foam board in below-grade applications.

8 Claims, 2 Drawing Sheets

THERMOPLASTIC FOAM INSULATION AND DRAINAGE BOARD IN BELOW-GRADE APPLICATIONS

CROSS-REFERENCE TO RELATED APPLICATION

The present application is a Rule 53 continuation of U.S. Ser. No. 08/295,368, filed Aug. 24, 1994, now U.S. Pat. No. 5,511,346.

BACKGROUND OF THE INVENTION

This invention relates to a rigid, thermoplastic foam board used in below-grade insulating and drainage applications.

A common problem observed in below-grade building walls is water damping (staining) or water seepage (leakage) in the walls. Below-grade building walls are walls which are partly or entirely situated below ground level, and typically abut a backfill of soil, clay, gravel, or other earth surface materials.

During rainfall or flooding, it is common for the backfill abutting or adjacent the building wall to become saturated with water. The water saturation causes substantial hydrostatic (water) pressure, which may cause water to permeate or seep through the building wall, which is typically composed of porous materials such as cinder blocks or poured concrete.

The exterior of building walls may be coated with a water-repelling substance such as black tar to reduce seepage, but such substances only slow seepage instead of preventing it.

Another problem with water seepage is that it leaves the building wall damp or wet, which increases heat loss through the building wall.

It would be desirable to have a means for protecting a below-grade building wall from water seepage. It would further be desirable to have a means for reducing or relieving the hydrostatic pressure of the water in backfill abutting the exterior of the building wall.

SUMMARY OF THE INVENTION

According to the present invention, there is a rigid, thermoplastic foam insulation board. The board defines a plurality of channels extending therein from a face or exterior surface of the board. The channels are generally unidirectionally oriented, and traverse the length of the board. Each of the channels extends into the board through a relatively narrow first opening at a face of the board into a relatively wide first zone. The channel then further extends from the first zone through a relatively narrow second opening into a second zone. The first and second zones are adapted to convey water from one end of the channel to the other end. The foam board is useful in below-grade insulating and drainage applications. The foam board resists incursion or clogging by backfill.

Further according to the present invention, there is a method for insulating and draining a below-grade building wall. The method comprises: a) providing the below-grade building wall; b) providing the insulating board described above; c) applying the insulating board to the exterior surface of the building wall with the channels directed outward away from the building wall; and d) back-filling adjacent the building wall and the channeled face of the insulating board.

Reference to the terms "relatively narrow" and "relatively wide" refer to the relative width of the channel in cross-section at various locations in the channel; the cross-section corresponds to that of FIG. 2 below. Width is transverse or perpendicular to the direction of extension of the channel into the foam board.

BRIEF DESCRIPTION OF THE DRAWINGS

The features of the present invention will be better understood upon viewing the drawings.

DETAILED DESCRIPTION

Figure 1:
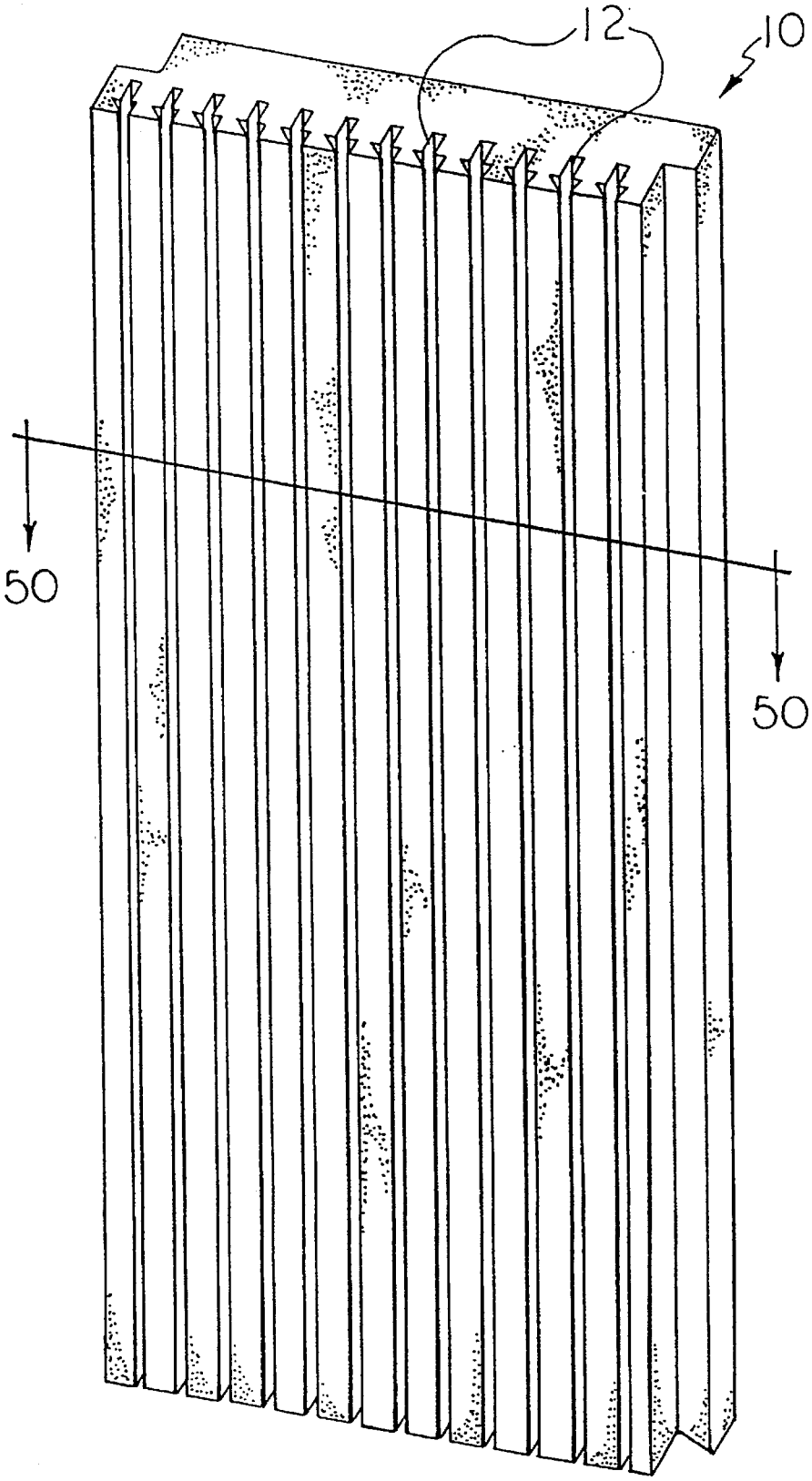
FIG. 1 shows a perspective view of the foam board of the present invention.

The present foam board reduces seepage through a below-grade building wall by providing channels to allow water to drain to the bottom of the board and into a suitable drainage means. The channels reduce or relieve hydrostatic pressure in the backfill. Hydrostatic pressure is reduced or relieved when water seeps from the backfill into the channels and down to the bottom of the board into a drainage means such as a drain or weeping tile.

The channels are configured or adapted to allow passage of water yet resist or minimize incursion or clogging by backfill. Each of the channels extends into the board through a relatively narrow first opening at a face of the board; the first opening is wide enough to allow passage of water, but narrow enough to resist or minimize incursion by the backfill. The channel extends through the first opening into a relatively wide first zone. The channel then extends from the first zone further through a relatively narrow second opening into a second zone. The relatively narrow second opening further resists or minimizes incursion by backfill. Because of the relatively wide configuration of the first zone and the relatively narrow configuration of the second opening, backfill particles which manage to enter the first zone through the first opening tend to accumulate and coalesce in the wide first zone. Accumulated particles can plug or block the second opening, effectively sealing off the second zone to incursion by the backfill.

Since the channels have two relatively narrow openings in series with a wider zone in between, the foam board is able to provide effective water drainage over extended periods of time and even with partial or substantial incursion by backfill. Even after partial or substantial incursion of backfill into the channels, water may still drain through the channels through some or substantial portions of the second zone and some portions of the first zone. The two relatively narrow openings (first and second openings) in series within the same channel reduce the impact of backfill incursion on water drainage over what it would be with a channel having only one opening.

In the foam board, the first opening preferably has a width of from about ⅛ inch (3.2 millimeters (mm)) to about ⅝ inch (16 mm), and most preferably has a width of about 3/16 inch (4.8 mm). The first zone preferably has a maximum width of from about ¼ inch (6.4 mm) to about ¾ inch (19 mm), and most preferably has a maximum width of about ⅜ inch (9.5 mm). The second opening preferably has a width of from about 1/16 inch (1.6 mm) to about 1/4 inch (6.4 mm), and most preferably has a width of about 1/8 inch (3.2 mm). The second zone should have sufficient cross-sectional area either alone or in conjunction with the first zone to provide effective drainage flow capability. Most preferably, the second zone is the same width as the second opening. The channels are preferably spaced from about 1 inch to about 3 inches apart (center to center), and most preferably about 2 inches apart. The channels are spaced close enough together to provide effective drainage flow capability. Drainage capability is a function of channel configuration and size and channel spacing.

Figure 2:
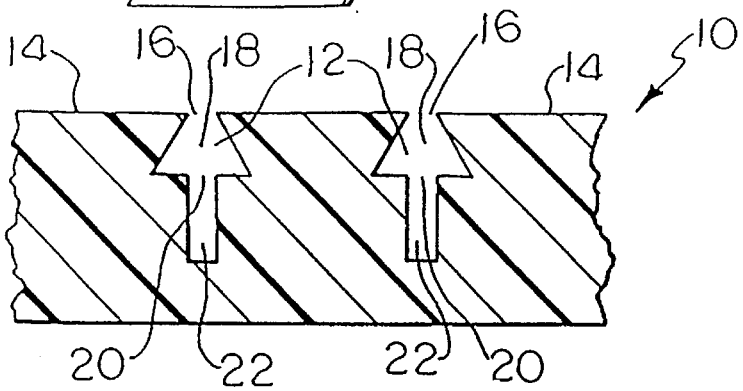
FIG. 2 shows a cross-sectional view along a line 50—50 of the board of FIG. 1.

A preferred design of the present board is seen in FIGS. 1 and 2. An insulation board 10 has channels 12, which in cross-section take the general shape of a blunt-ended "arrow". The blunt end of the arrow opens to the exterior surface or face 14 of board 10. Channel 12 defines a relatively narrow first opening 16 at face 14, then increases in width as it extends to the interior of board 10 to define a first zone 18. First zone 18 in cross-section takes the general shape of a blunt-ended triangle. Groove 12 then narrows in width as it extends further to the interior of board 10 to define a second opening 20, which opens into a second zone 22 further to the interior of board 10. The second zone 22 is relatively narrow and rectangular in cross-section. Second opening 20 is narrower in width than first opening 16.

Figure 3:
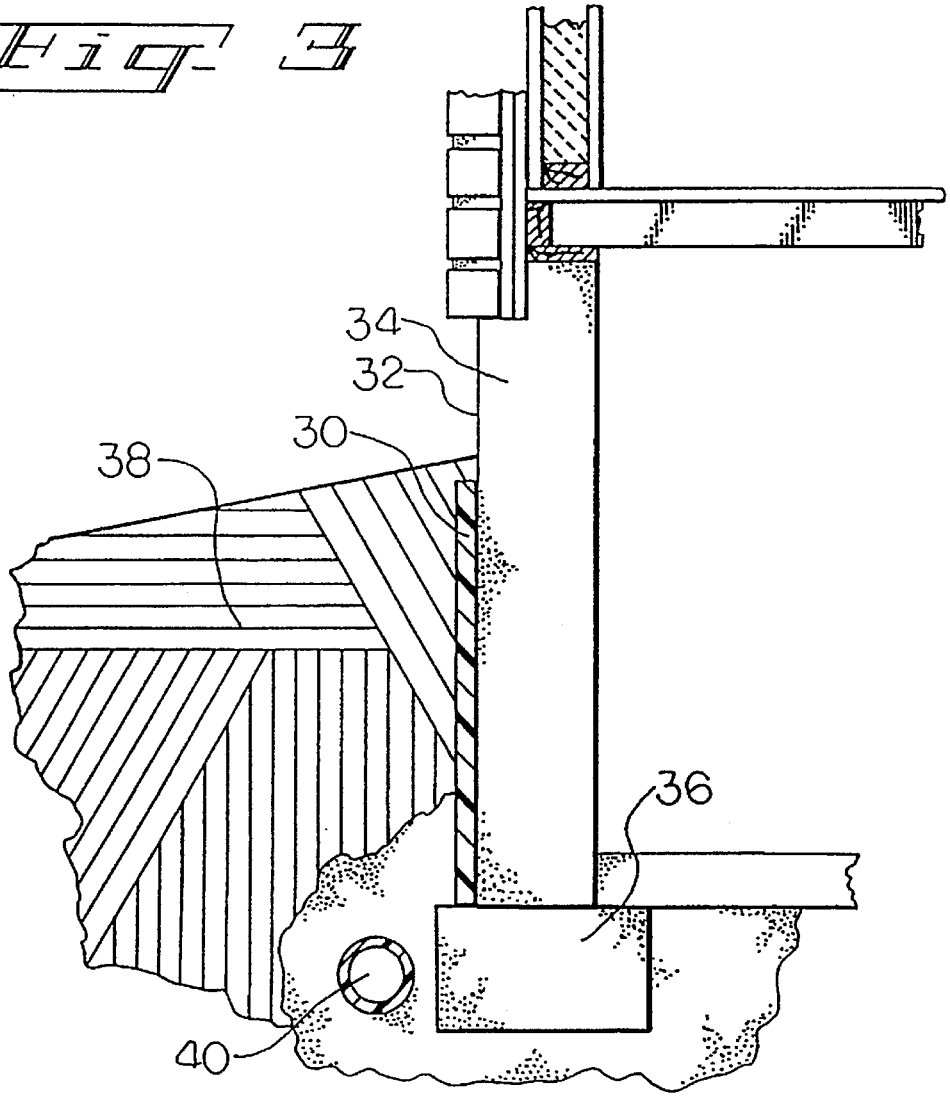
FIG. 3 shows a cross-sectional view of a foam board of the present invention in a below-grade application at a building wall of a building.

The present foam board may be employed in a below-grade insulating application as illustrated in FIG. 3. A foam board 30 abuts the exterior surface 32 of a building wall 32, a concrete footer 36, and backfill 38. The foam board 30 may take the form of board 10 shown in FIG. 1. Foam board 30 may be attached to exterior surface 32 by any means known in the art such as an adhesive (not shown) or a mechanical fastener (not shown). Foam board 30 has channels (not shown) which abut and open toward backfill 38. Water drains down the channels (not shown) into a drain tile 40 for disposal.

Another advantage of the present foam board is that it provides insulation for the building wall by limiting seepage and providing an insulating material on the exterior surface of the building wall. Extra heat loss through damp or wet areas in the building wall is reduced.

The present foam board may be comprised of any rigid thermoplastic. The present foam board preferably comprises an alkenyl aromatic polymer material. Suitable alkenyl aromatic polymer materials include alkenyl aromatic homopolymers and copolymers of alkenyl aromatic compounds and copolymerizable ethylenically unsaturated comonomers. The alkenyl aromatic polymer material may further include minor proportions of non-alkenyl aromatic polymers. The alkenyl aromatic polymer material may be comprised solely of one or more alkenyl aromatic homopolymers, one or more alkenyl aromatic copolymers, a blend of one or more of each of alkenyl aromatic homopolymers and copolymers, or blends of any of the foregoing with a non-alkenyl aromatic polymer. Regardless of composition, the alkenyl aromatic polymer material comprises greater than 50 and preferably greater than 70 weight percent alkenyl aromatic monomeric units. Most preferably, the alkenyl aromatic polymer material is comprised entirely of alkenyl aromatic monomeric units.

Suitable alkenyl aromatic polymers include those derived from alkenyl aromatic compounds such as styrene, alpha-methylstyrene, ethylstyrene, vinyl benzene, vinyl toluene, chlorostyrene, and bromostyrene. A preferred alkenyl aromatic polymer is polystyrene. Minor amounts of monoethylenically unsaturated compounds such as $C_{2-6}$ alkyl acids and esters, ionomeric derivatives, and $C_{4-6}$ dienes may be copolymerized with alkenyl aromatic compounds. Examples of copolymerizable compounds include acrylic acid, methacrylic acid, ethacrylic acid, maleic acid, itaconic acid, acrylonitrile, maleic anhydride, methyl acrylate, ethyl acrylate, isobutyl acrylate, n-butyl acrylate, methyl methacrylate, vinyl acetate and butadiene. Preferred structures comprise substantially (i.e., greater than 95 percent) and most preferably entirely of polystyrene.

The foam board has the density of from about 10 to about 150 and most preferably from about 10 to about 70 kilograms per cubic meter according to ASTM D-1622-88. The foam has an average cell size of from about 0.1 to about 5.0 and preferably from about 0.2 to about 1.5 millimeters according to ASTM D3576-77.

The foam board is closed cell. Preferably, the present foam is greater than 90 percent closed-cell according to ASTM D2856-87.

A preferred foam insulation board is an extruded, polystyrene foam board. Extruded polystyrene is preferred because of its high compressive strength, low water vapor permeability, and low water solubility. High compressive strength enables the foam board to withstand compression by the backfill. The low water vapor permeability and low water solubility of the board enhances its long-term mechanical strength, and limits passage of water and water vapor through it. The extruded foam board preferably has a compressive strength of about 25 pounds per square inch (psi) (172.25 kilopascals (kPa)) to about 35 psi (241.15 kPa), and most preferably from about 25 psi (172.25 kPa) to about 30 psi (206.7 kPa). The board preferably has a water vapor permeation rate of about 60 nanograms per square meter per hour or less.

An extruded, rigid thermoplastic board of the present invention is generally prepared by heating a thermoplastic to form a plasticized or melt thermoplastic, incorporating therein a blowing agent to form a foamable gel, and extruding the gel through a die to form the foam product. Prior to mixing with the blowing agent, the thermoplastic is heated to a temperature at or above its glass transition temperature or melting point. The blowing agent may be incorporated or mixed into the thermoplastic melt by any means known in the art such as with an extruder, mixer, blender, or the like. The blowing agent is mixed with the thermoplastic melt at an elevated pressure sufficient to prevent substantial expansion of the thermoplastic melt and to generally disperse the blowing agent homogeneously therein. Optionally, a nucleator may be blended in the polymer melt or dry blended with the thermoplastic prior to plasticizing or melting. The foamable gel is typically cooled to a lower temperature to optimize physical characteristics of the foam structure. The gel may be cooled in the extruder or other mixing device or in separate coolers. The gel is then extruded or conveyed through a die of desired shape to a zone of reduced or lower pressure to form the foam structure. The zone of lower pressure is at a pressure lower than that in which the foamable gel is maintained prior to extrusion through the die. The lower pressure may be superatmospheric or subatmospheric (vacuum), but is preferably at an atmospheric level.

Blowing agents useful in making the present foam structure include inorganic agents, organic blowing agents and chemical blowing agents. Suitable inorganic blowing agents include carbon dioxide, nitrogen, argon, water, air, nitrogen, and helium. Organic blowing agents include aliphatic hydrocarbons having 1–9 carbon atoms, aliphatic alcohols having 1–3 carbon atoms, and fully and partially halogenated aliphatic hydrocarbons having 1–4 carbon atoms. Aliphatic hydrocarbons include methane, ethane, propane, n-butane, isobutane, n-pentane, isopentane, neopentane, and the like. Aliphatic alcohols include methanol, ethanol, n-propanol, and isopropanol. Fully and partially halogenated aliphatic hydrocarbons include fluorocarbons, chlorocarbons, and chlorofluorocarbons. Examples of fluorocarbons include methyl fluoride, perfluoromethane, ethyl fluoride, 1,1-difluoroethane (HFC-152a), 1,1,1-trifluoroethane (HFC-143a), 1,1,1,2-tetrafluoro-ethane (HFC-134a), pentafluoroethane, difluoromethane, perfluoroethane, 2,2-difluoropropane, 1,1,1-trifluoropropane, perfluoropropane, dichloropropane, difluoropropane, perfluorobutane, perfluorocyclobutane. Partially halogenated chlorocarbons and chlorofluorocarbons for use in this invention include methyl chloride, methylene chloride, ethyl chloride, 1,1,1-trichloroethane, 1,1-dichloro-1-fluoroethane (HCFC-141b), 1-chloro-1,1-difluoroethane (HCFC-142b), chlorodifluoromethane (HCFC-22), 1,1-dichloro-2,2,2-trifluoroethane (HCFC-123) and 1-chloro-1,2,2,2-tetrafluoroethane (HCFC-124). Fully halogenated chlorofluorocarbons include trichloromonofluoromethane (CFC-11), dichlorodifluoromethane (CFC-12), trichlorotrifluoroethane (CFC-113), 1,1,1-trifluoroethane, pentafluoroethane, dichlorotetrafluoroethane (CFC-114), chloroheptafluoropropane, and dichlorohexafluoropropane. Chemical blowing agents include azodicarbonamide, azodiisobutyronitrile, benzenesulfonhydrazide, 4,4-oxybenzene sulfonylsemicarbazide, p-toluene sulfonyl semi-carbazide, barium azodicarboxylate, N,N'-dimethyl-N,N'-dinitrosoterephthalamide, and trihydrazino triazine. A preferred blowing agent is HCFC-142b.

The amount of blowing agent incorporated into the polymer melt material to make an extrudable polymer gel is from about 0.2 to about 5.0 gram-moles per kilogram of polymer, preferably from about 0.5 to about 3.0 gram-moles per kilogram of polymer, and most preferably from about 1.0 to 2.50 gram-moles per kilogram of polymer.

A nucleating agent may be added in order to control the size of foam cells during foaming. Preferred nucleating agents include inorganic substances such as calcium carbonate, talc, clay, titanium dioxide, silica, barium stearate, diatomaceous earth, mixtures of citric acid and sodium bicarbonate, and the like. The amount of nucleating agent employed may range from about 0.01 to about 5 parts by weight per hundred parts by weight of a polymer resin. The preferred range is from 0.1 to about 3 parts by weight.

Various other additives may be incorporated in the present foam structure such as inorganic fillers, pigments, antioxidants, acid scavengers, ultraviolet absorbers, flame retardants, processing aids, extrusion aids, and the like.

Though the preferred foam configuration is an extruded board, it is understood that the foam board may be fashioned from an expanded thermoplastic bead foam (bead board). The bead foam may be formed by expansion of pre-expanded beads containing a blowing agent. The expanded beads may be molded at the time of expansion to form to the shape of a foam board. The foam board may then be mechanically fabricated to form the channels into the board as further described herein. Processes for making pre-expanded beads and molded expanded bead articles are taught in *Plastic Foams, Part II*, Frisch and Saunders, pp. 544–585, Marcel Dekker, Inc. (1973) and *Plastic Materials*, Brydson, 5th ed., pp. 426–429, Butterworths (1989), which are incorporated herein by reference.

The present foam board is useful in both residential and commercial below-grade building applications.

While embodiments of the foam board and the method of using same of the present invention have been shown with regard to specific details, it will be appreciated that depending upon the manufacturing process and the manufacturer's desires, the present invention may be modified by various changes while still being fairly within the scope of the novel teachings and principles herein set forth.

What is claimed is:

1. A below-grade insulating structure, comprising:

a) a below-grade building wall having an exterior surface;

b) a rigid, thermoplastic foam board in abutment with the exterior surface of the building wall, the board defining a plurality of channels extending therein from a face of the board, the channels being generally unidirectionally oriented along the board, channel extending into the board through a relatively narrow first opening at the face into a relatively wide first zone, each channel further extending into the board from the first zone through a relatively narrow second opening into a second zone, the first and second zones being adapted to convey water from one end of each channel to the other end, the channels being directed outward away from the building wall; and c) backfill adjacent the building wall and the channels of the foam board.

2. The insulating structure of claim 1, wherein the first openings have a width of from ⅛ inch to ⅝ inch, the first zones having a maximum width of from ¼ inch to ¾ inch, and the second openings having a width of from 1/16 inch to ¼ inch.

3. The insulating structure of claim 1, wherein each channel has the general shape of a blunt-ended arrow, the blunt end of the arrow opening at the face.

4. The insulating structure of claim 2, wherein each channel has the general shape of a blunt-ended arrow, the blunt end of the arrow opening at the face.

5. The insulating structure of claim 1, wherein the board is an extruded polystyrene board.

6. The insulating structure of claim 2, wherein the board is an extruded polystyrene board.

7. The insulating structure of claim 3, wherein the board is an extruded polystyrene board.

8. The insulating structure of claim 1, wherein the board is a polystyrene bead board.

* * * * *